US009500428B2

(12) United States Patent
Kleinfelder

(10) Patent No.: US 9,500,428 B2
(45) Date of Patent: Nov. 22, 2016

(54) ADJUSTABLE, PORTABLE, PIVOTAL FIREARM SHOOTING SEAT AND STAND

(71) Applicant: Roger Kleinfelder, Homewood, IL (US)

(72) Inventor: Roger Kleinfelder, Homewood, IL (US)

( * ) Notice: Subject to any disclaimer, the term of this patent is extended or adjusted under 35 U.S.C. 154(b) by 0 days.

(21) Appl. No.: 14/790,494

(22) Filed: Jul. 2, 2015

(65) Prior Publication Data

US 2016/0003571 A1 Jan. 7, 2016

Related U.S. Application Data

(60) Provisional application No. 62/020,523, filed on Jul. 3, 2014.

(51) Int. Cl.
*F41A 23/16* (2006.01)
*F41A 23/56* (2006.01)

(52) U.S. Cl.
CPC ..... *F41A 23/16* (2013.01); *F41A 23/56* (2013.01)

(58) Field of Classification Search
CPC ..... F41A 23/16; F41A 23/02; F41A 23/56
USPC ..... 42/94; 89/37.04
See application file for complete search history.

(56) References Cited

U.S. PATENT DOCUMENTS

| | | | | |
|---|---|---|---|---|
| 3,711,984 A | | 1/1973 | Dyer et al. | |
| 5,414,949 A | * | 5/1995 | Peebles | F41A 23/16 42/94 |
| 6,058,641 A | * | 5/2000 | Vecqueray | F41A 23/12 248/425 |
| 7,168,199 B2 | * | 1/2007 | Krien | A47B 83/02 42/90 |
| 7,731,278 B1 | * | 6/2010 | Brownlee | F41C 27/22 248/170 |

FOREIGN PATENT DOCUMENTS

DE 2028792 * 6/1970

OTHER PUBLICATIONS http://www.cabelas.com/catalog/search/?N=&No=0 &Ntk=AllProducts&Ntt=shooting+bench &Ntx=mode%2Bmatchallpartial&WTz_l=Header%3BSearch-All+Products&WTz_st=&WTz_stype=SP&form_ state=searchForm&recordsPerPage=20&search=shooting+bench &searchTypeByFilter=AllProducts&x=10&y=6.
http://www.cabelas.com/product/Herters174-Shooting-Bench/1851833.uts?Ntk=AllProducts &searchPath=%2Fcatalog%2Fsearch.cmd%3Fform_ state%3DsearchForm%26N%3D0%26fsch%3Dtrue%26Ntk%-3DAllProducts%26Ntt%3Dshooting%2Bbench%26x%3D10%-26y%3D6%26WTz_l %3DHeader%253BSearch-All%2BProducts &Ntt=shooting+bench.
http://www.cabelas.com/product/Big-Game-Swivel-Action-Shooting-Bench/708606.uts?Ntk=AllProducts &searchPath=%2Fcatalog%2Fsearch.cmd%3Fform_ state%3DsearchForm%26N%3D0%26fsch%3Dtrue%26Ntk%-3DAllProducts%26Ntt%3Dshooting%2Bbench%26x%3D10%-26y%3D6%26WTz_l%3DHeader%253BSearch-All%2BProducts &Ntt=shooting+bench.
http://www.cabelas.com/product/Caldwell174-Stable-Table174-Shooting-Bench/708873.uts?Ntk=AllProducts &searchPath=%2Fcatalog%2Fsearch.cmd%3Fform_ state%3DsearchForm%26N%3D0%26fsch%3Dtrue%26Ntk%-3DAllProducts%26Ntt%3Dshooting%2Bbench%26x%3D10%-26y%3D6%26WTz_l%3DHeader%253BSearch-All%2BProducts &Ntt=shooting+bench.

* cited by examiner

*Primary Examiner* — Stephen M Johnson
(74) *Attorney, Agent, or Firm* — Rockman, Videbeck & O'Connor; Mercedes V. O'Connor; Howard B. Rockman

(57) ABSTRACT

An adjustable, portable and pivotal seat and stand assembly that includes a base structure, a removable shaft, a plurality of outwardly extending angularly adjustable legs pivotally attached to the base structure, a seat assembly pivotally and vertically movable between fixed positions relative to the shaft, and a support table mounted to the upper end of the shaft. The seat and table are height adjustable for supporting a user whether seated or standing when shooting moving and still targets. The legs are easily adjustable by the user when the seat and stand assembly is used on uneven terrain. The seat and stand assembly also allows for easy storage and portability by removing the seat and table and sliding the shaft down through the base structure.

19 Claims, 8 Drawing Sheets

ADJUSTABLE, PORTABLE, PIVOTAL FIREARM SHOOTING SEAT AND STAND

This application claims priority to provisional patent application Ser. No. 62/020,523, filed Jul. 3, 2014, to the extent allowed by law.

BACKGROUND OF THE INVENTION

1. Field of the Invention

The present invention relates generally to an adjustable, portable and pivotal seat and stand assembly for one shooting firearms. More particularly, the invention is a pivotable and height adjustable seat and table rest for supporting a shooter whether seated or standing, during the process of shooting moving or still targets at great distances, wherein the legs of the seat and stand assembly are easily adjustable by the user when the seat and stand assembly is used on uneven terrain.

2. Background of the Invention

Seat and table rests and supports to stabilize a shooter when using a firearm, particularly a rifle, are known in the art. The shooter desires to be still and stable when sighting on a target, and at times the shooter may be located on an uneven terrain, which inhibits the desired stabilization.

One example of a prior seat and table rest assembly is found in U.S. Pat. No. 6,058,641 to Vecqueray, which discloses a pivotally and vertically adjustable support surface and seat for supporting a shooter on the seat and a support surface configured to rotate in tandem with the seat about a vertical axis. While the Vecqueray device, in one embodiment, permits manual adjustment of its supporting legs, the adjustment mechanism disclosed in this reference, due to the inadequate distance between the pivot point of the legs and the leg adjusting screw, makes it very difficult to adjust the legs of the reference device to a desired position, particularly when the shooter is seated on the seat. Further, the assembly of the legs in the reference device does not allow the legs to be pivoted upward and together to allow greater portability of the support structure.

Another example of a portable shooting bench assembly is disclosed in U.S. Pat. No. 3,711,984 to Dyer et al. This shooter's bench assembly has a plurality of telescoping tubes attached to flat support legs for adjustable ground support. The telescoping tubes are locked by cotter pins. However, the Dyer et al. device does not provide a leveling adjustment mechanism that is readily accessible to a shooter sitting on the bench, nor is easily and variably adjusted to any position depending on the variances in ground level.

In bench shooting, a user is seated or standing adjacent a table rest to fire successive rounds at either fixed or moving targets. These table rests are normally large metal frames or concrete benches to stabilize the shooter and the firearm.

When shooting at multiple moving targets, bench rests for stationary target shooting do not allow the shooter to reset or reaim the firearm in a different direction. Bench rests have been designed for use with multiple moving targets, some with fixed legs or supports that do not allow adjustment when the bench and stand assembly is placed on uneven ground. This results in the axis of rotation of the table and bench veering off the vertical, such that gravity forces compel the components to lean toward the lowest point of rotation, which causes the shooter to undesirably rotate away from the intended target.

Some rotatable shooter's bench and stand assemblies are available that provide adjustment of the position of the legs supporting the assembly. However, the mechanisms for achieving such adjustment on available devices require a substantial exertion of energy by the user to make the desired leg adjustment, and such mechanisms are usually inaccessible to a user seated on the bench and stand assembly.

SUMMARY OF THE INVENTION

The present invention in the illustrated embodiment includes: a base structure; a removable shaft extending upward from the base structure; a plurality of outwardly extending angularly adjustable legs pivotally attached to the base structure; a seat assembly pivotally and vertically moveable between fixed positions along the axis of the shaft; and a support table or surface mounted to the upper end of the shaft. The support table and seat are initially rotatable around the shaft, but are normally fixed to rotate together with the shaft when the assembly is being used by a shooter while aiming at a target.

The seat and table of the present invention are initially vertically adjustable relative to each other to accommodate a multitude of shooters. The supporting legs of the present invention are easily adjustable and readily accessible to the user to change the angle of any or all of the legs when the assembly is placed on uneven terrain. This adjustment allows the axis of rotation of the shaft to be maintained in a vertical direction on uneven terrain.

In one embodiment, the present invention is made primarily of aluminum parts to provide portability and light weight to the assembly. The legs of the present invention are also permitted to pivot and be positioned adjacent and parallel to each other, and parallel to the shaft, when it is desired to carry the assembly, or store the assembly in the trunk of an automobile, for instance.

These and other advantages of the invention will become more readily apparent by reference to the accompanying drawing and the following detailed description of the invention.

DETAILED DESCRIPTION OF THE ILLUSTRATED EMBODIMENT

Figure 1:
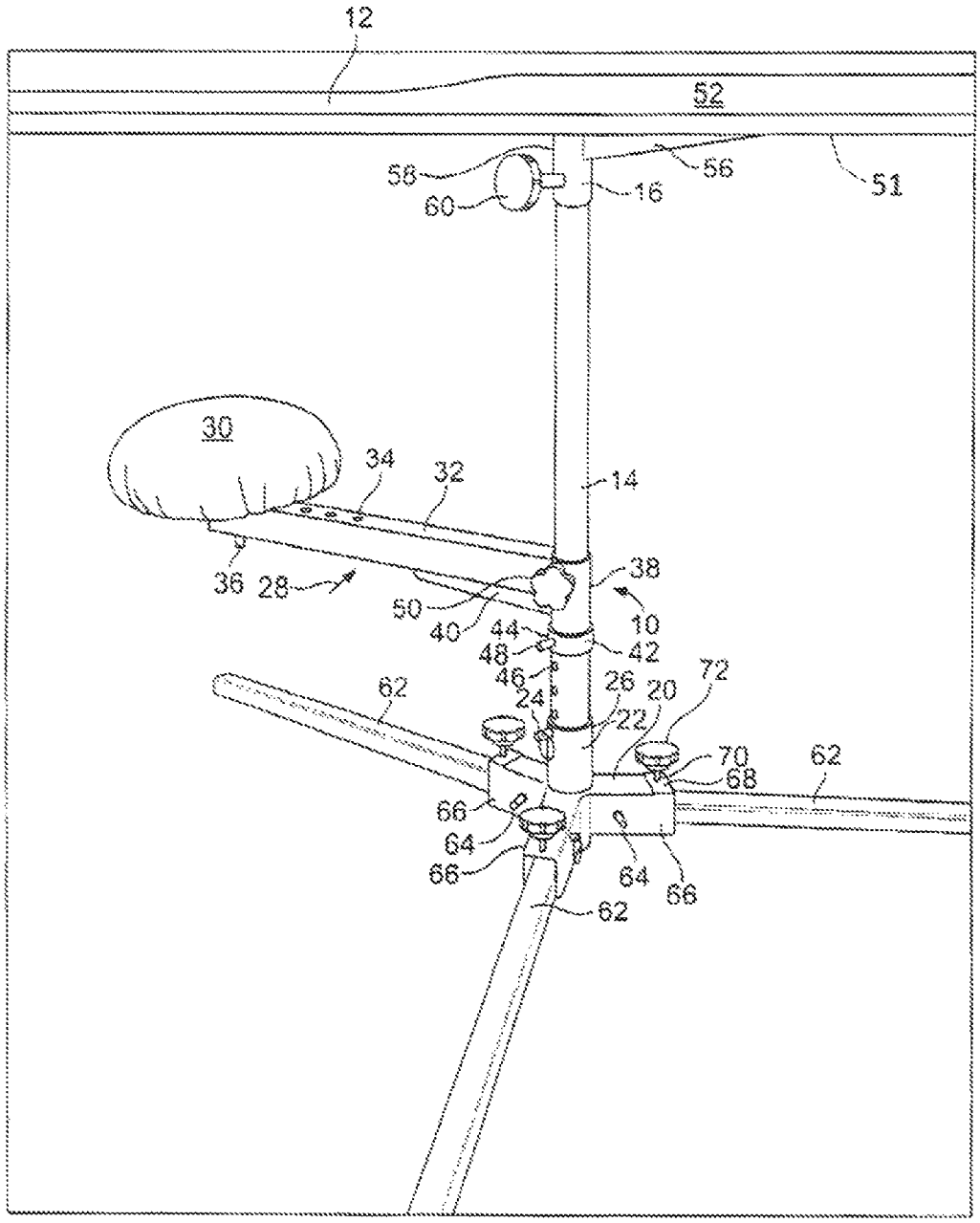
FIG. 1 is a perspective view of the shooting seat and table stand assembly of the present invention configured for use.
Figure 2:
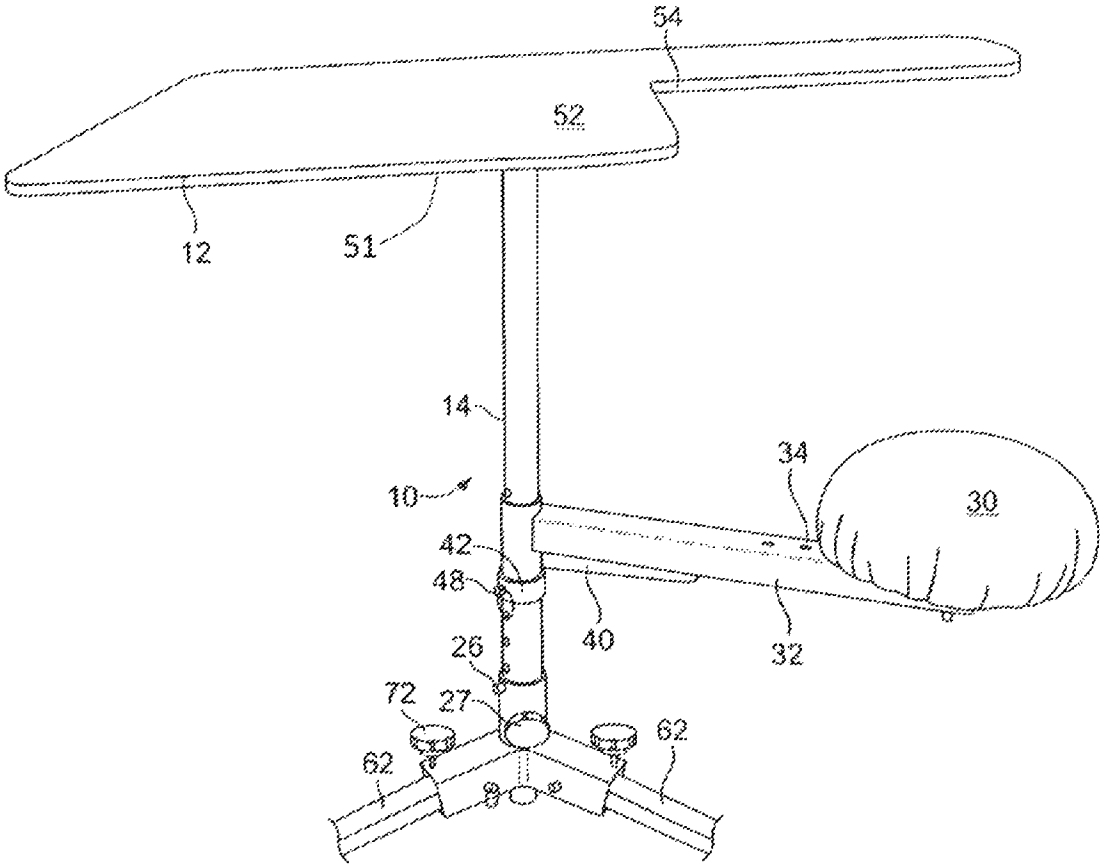
FIG. 2 is a perspective view of the shooting seat and table stand assembly of FIG. 1, showing the assembly at a different angle with reference to FIG. 1.

Referring to FIGS. 1 and 2, the shooting seat and table stand assembly of the present invention is designated by the number 10. A table or support 12 is mounted on the top end of shaft 14 by means of a cylindrical bracket 16 firmly attached to a base 51 of table 12. A threaded shaft and knob assembly 18 extends through an aperture in bracket 16 to rotatably secure table 12 to the top end of shaft 16. Shaft and knob assembly 60, when rotated counterclockwise as seen in FIG. 1, also allows table 12 to be readily removed from the top of shaft 14 for ease of storage and transport of shooting seat and table stand 10.

Figure 8:
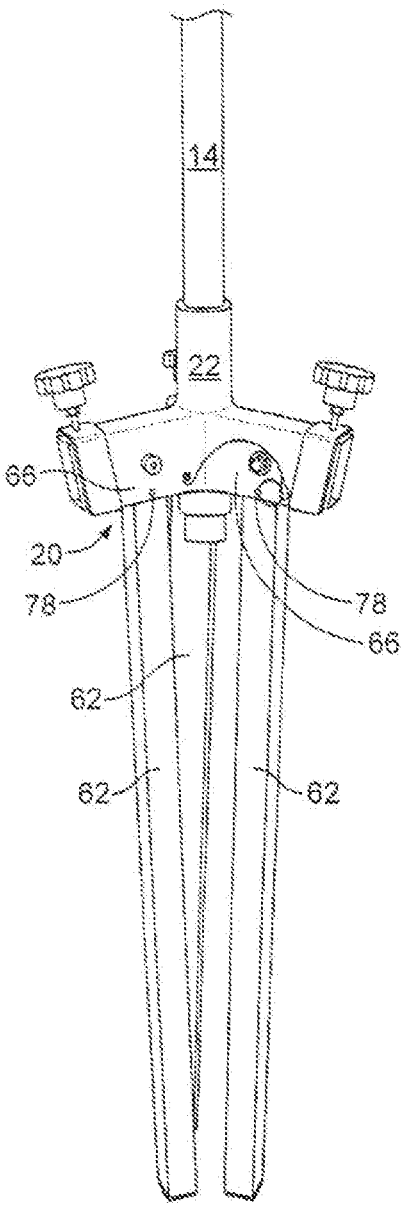
FIG. 8 is a perspective view showing the support shaft, base portion and legs of the seat and table stand assembly of FIG. 4, with the support shaft extended upward from the base and the legs pivotally folded into their transport or storage position.
Figure 9:
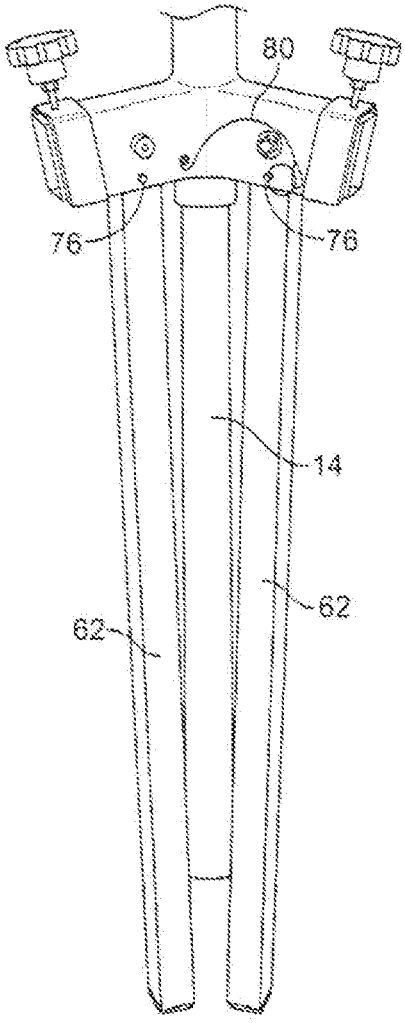
FIG. 9 is a perspective view similar to FIG. 8, only showing the support shaft lowered through the base or hub portion in a transport or storage position.
Figure 10:
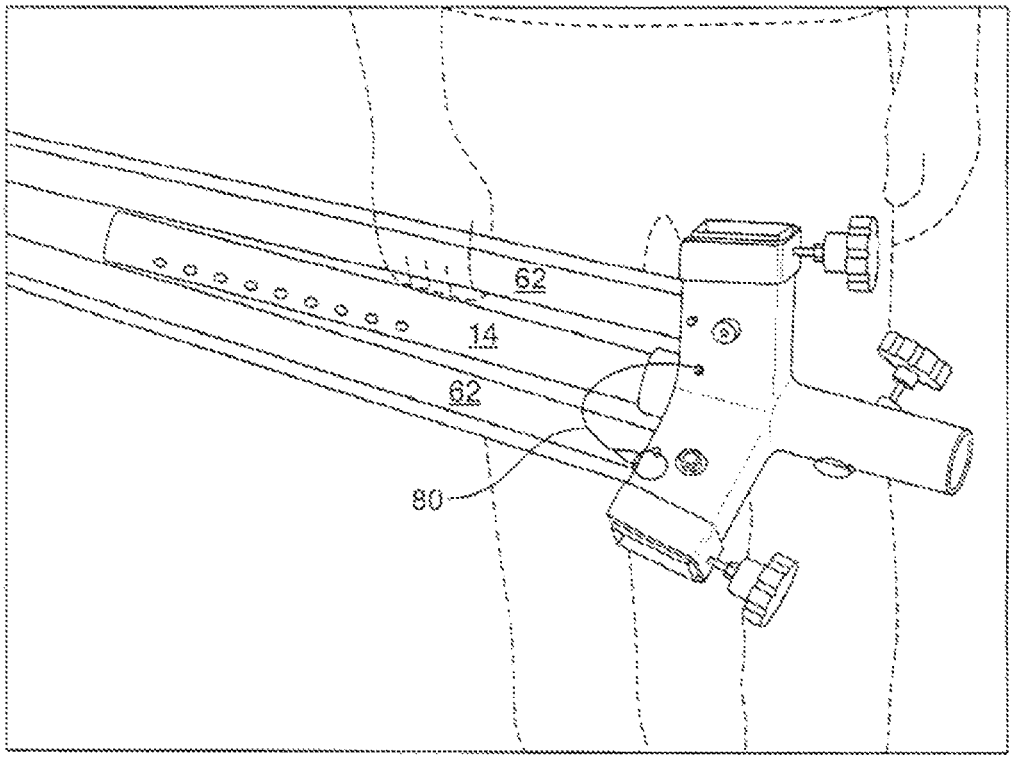
FIG. 10 is a perspective view of the support shaft, legs and base portion of the device of FIG. 1 in a stored or transport position, being manually transported by a user.

A base or hub assembly 20 is adjustably mounted to the lower end of shaft 14. A hollow cylindrical mounting bracket 22 attached to base assembly 20 receives the lower end of shaft 14. Mounting bracket 22 is bottomless, such that shaft 14 can extend through base assembly 20 for storage and carrying purposes, as seen in FIGS. 8-10. Mounting bracket 22 includes opposed apertures 24 adapted to receive a removable pin 26 that also extends through a pair of opposed lower apertures in shaft 14 (not shown) adjacent the bottom of shaft 14 to secure shaft 14 to base assembly 20 as seen in FIGS. 1-3.

Figure 3:
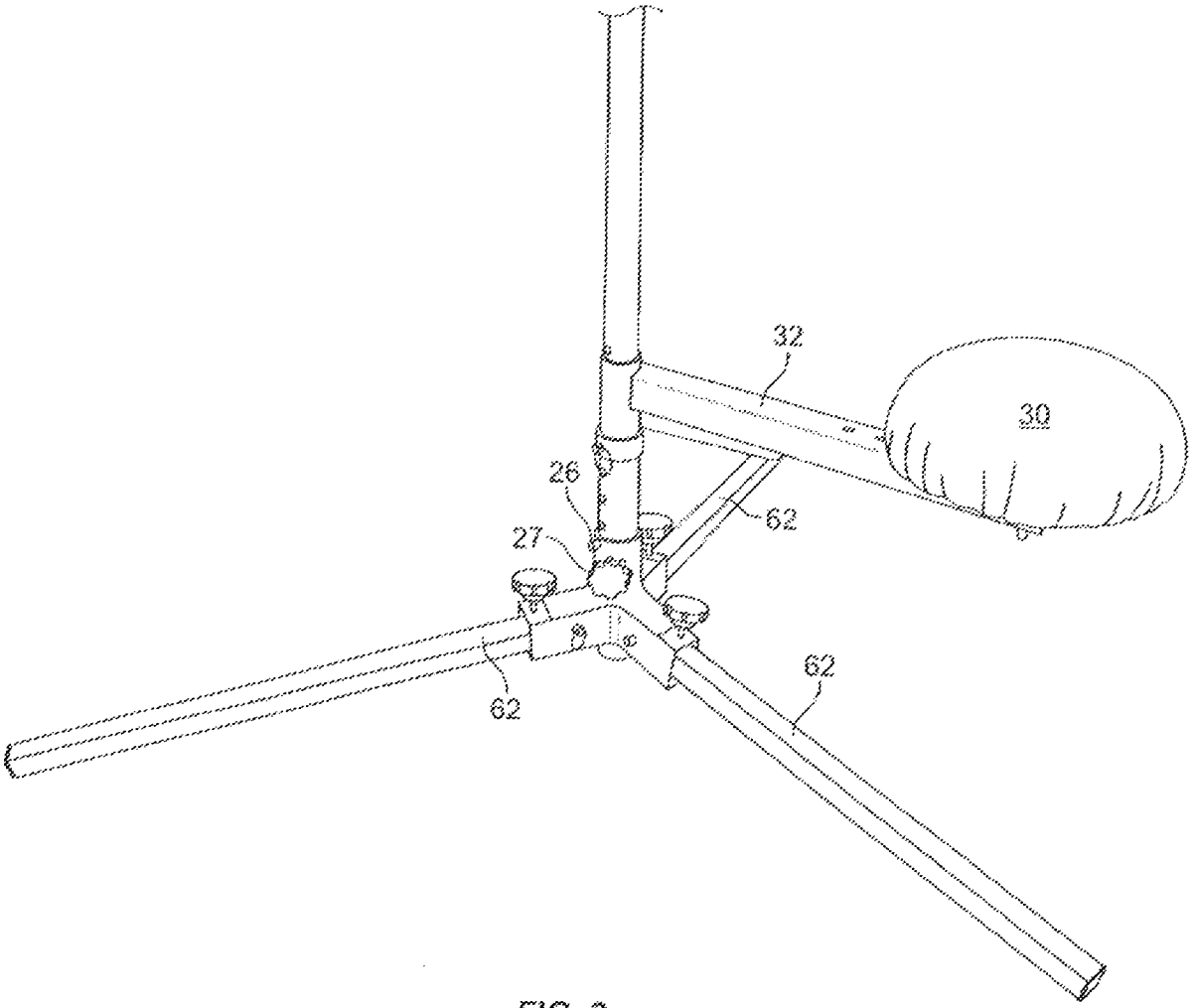
FIG. 3 is a close-up perspective view of the seat and pivotal leg portions of the shooting seat and table stand assembly of FIG. 1.

As seen in FIGS. 1-3, a seat assembly 28 is mounted on shaft 14 for vertical movement along the axis of shaft 14. Seat assembly 28 comprises seat 30 rotatably supported on cantilever arm 32. A plurality of linearly arrayed and opposed apertures 34 extend through arm 32. The apertures removably receive a shaft 36 attached to the bottom of seat 30. By inserting shaft 36 into the appropriate opposed apertures 34, the lateral position of the seat can be adjusted relative to table 12 for the comfort of the user.

Arm 32 is rigidly supported on hollow cylindrical bracket 38 that is vertically adjustable along the axis of shaft 14. A support plate 40 is also rigidly attached to cylindrical bracket 38, and extends beneath and is attached to the under-surface of arm 32 to provide additional support for arm 32 when a user is seated on seat 30.

Located beneath cylindrical bracket 38 is a collar 42 that is freely vertically movable along shaft 14. Collar 42 includes a pair of opposed apertures 44 that are adapted to be in alignment with one of several opposed apertures 46 in shaft 14. A removable pin 48 extends through apertures 44 and 46 to secure collar 42 in a fixed position on the vertical axis of shaft 14. Cylindrical bracket 38 abuts the top of collar 42 by the force of gravity, such that the vertical position of collar 42 establishes the vertical position of arm 32 and seat 30 according to the user's preferences.

Cylindrical bracket 38 is rotatable about shaft 14 and rotatable on the upper surface of collar 42. A threaded knob 50 having a threaded shaft (not shown) is rotated once the user on the seat has established the desired rotative position of seat 30. This rotation causes the inner end of the threaded shaft attached to knob 50 to frictionally engage the shaft 14, thus preventing further rotation of the arm 32 and seat 30. If the user desires to rotate on seat 30 while shooting at moving targets, knob 50 is rotated to its unlocked position. Additionally seat 30 can be rotated out of the way and locked in position if the user desires to shoot from a standing position.

Table 12, in the illustrated embodiment of FIG. 2, comprises a somewhat L-shaped planar surface 52 configured to support a shooter's upper body and arms when aiming a firearm at a target. Other shapes for surface 52 may also be suitable. The cut out portion 54 of surface 52 may be equally dimensioned on both sides to allow the table 12 to be used by either right handed or left handed shooters.

Table 12 is supported by a triangular-shaped support bracket 56 (FIG. 1) that is rigidly attached at its wider end to a hollow bracket collar 58 that fits over the top end of shaft 14. Hollow bracket collar 58 and table 12 rotate freely about shaft 14, but can be locked in place on shaft 14 by tightening knob and threaded shaft assembly 60 (FIG. 1).

Table 12 is configured to support the user's upper body, arms and the firearm when the user shoots from a standing position. The vertical position of table 12 can be adjusted by removing pin 26 from one of the apertures 24, resetting the position of shaft 14 relative to mounting bracket 22, aligning another set of apertures 46 in shaft 14 with the apertures 24 in mounting bracket 22, and then reinserting pin 26 in newly aligned apertures 24 and 46.

In the illustrated embodiment of FIGS. 1-3, a plurality of legs 62 are pivotally attached by removable pins 64 to laterally extending inverted U-shaped mounting brackets 66. Brackets 66 are fixed to mounting bracket 22. The outer end of each leg is adapted to sit on the ground or other terrain to support shooting seat and table stand 10.

Legs 62 are adjustable to multiple angles about pins 64 in the present invention to allow the user to maintain a vertical orientation of shaft 14 when shooting seat and table stand assembly 10 is situated on uneven terrain. To this end, each bracket 66 extending from base assembly 20 includes a threaded aperture 68. A threaded shaft 70 fixed to a knob 72 rotates in each aperture 68, imparting vertical movement to the lower end of threaded shaft 70. The lower end of threaded shaft 70 abuts the top surface of each corresponding leg 62, which results in pivotal movement of each leg 62 about respective one of pins 64. This pivotal movement of each individual leg allows the outer end of each leg to be vertically adjusted to accommodate the vertical orientation of shaft 14 when shooting seat and table stand assembly 10 is placed on uneven terrain.

In previous shooting seat and table stand assemblies, it is very difficult to adjust the position of the legs while the user is seated on the seat. This problem occurs because the leg adjustment shaft is very close to or even on top of each pivotal connection between the inner extent of the legs and the leg brackets formed with the base. In such structures, the minimal or no distance between the pivotal connection and the threaded adjusting shaft does not provide sufficient leverage to enable a user seated on the seat to easily adjust the angle of one or more legs relative to the base support.

To solve this problem, the present invention locates each threaded aperture 68 in corresponding bracket 66 at a predetermined lateral distance from the axis of a corresponding pivot pin 64. In the illustrated embodiment the predetermined lateral distance between each pin 64 and a corresponding threaded aperture 68 is in the range of two inches. However, this distance may vary between approximately one and a half and four inches, or possibly more where the user is a heavy person. Due to the distance between each pivot pin 64 and each threaded aperture 68, as one or more knobs 72 are rotated and the lower end of threaded shaft 70 contacts and applies pressure to an upper surface of leg 62, the lateral distance between shaft 70 and pin 64 provides sufficient leverage to allow the legs 62 to be easily moved into a desired angular position. The threaded surfaces of aperture 68 and shaft 70 hold the weight of the user on seat 30, and maintain the desired angular position of each leg 62 after the proper adjustment has been made.

Referring to FIGS. 4-6 and 8-10, an embodiment of the present invention is illustrated that provides for the easy storage and transport of the shooting seat and table stand assembly 10. As described in conjunction with the embodiment of FIGS. 1-3, the table or support 12 can be easily removed from shaft 14 by loosening knob and threaded shaft assembly 60. Thus removed, table 12 can be stored or carried by the user. Similarly, by loosening threaded knob 50, hollow cylindrical bracket 38 can be lifted upward to the top of shaft 14 and seat 30 and arm 32 can also be removed for manual transport and/or storage. Collar 42 can likewise be removed from shaft 14, or can remain on shaft 14.

Figure 4:
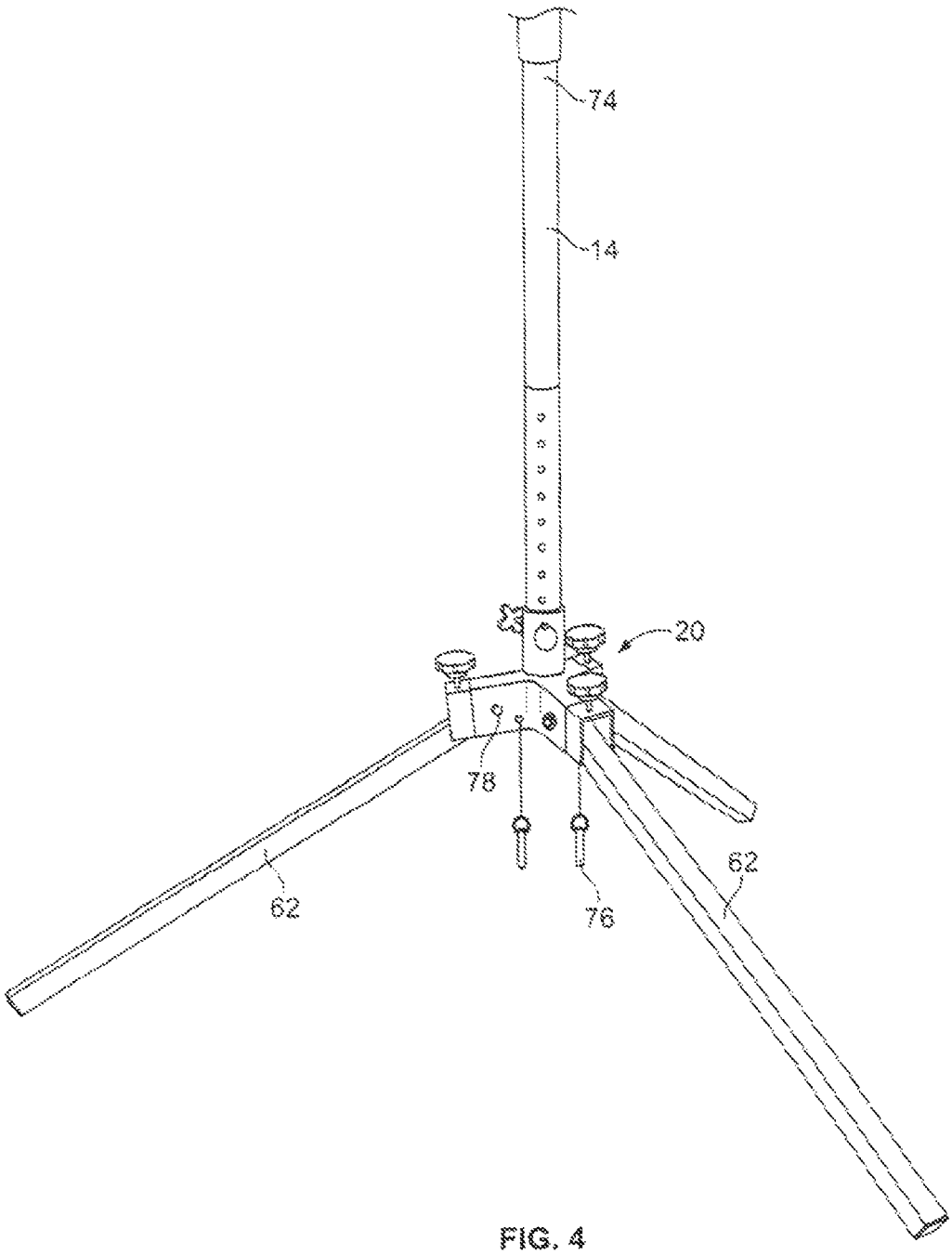
FIG. 4 is a perspective view of another embodiment of the shooting seat and table stand assembly of the present invention, showing the legs extended and the central shaft at its maximum extension.
Figure 5:
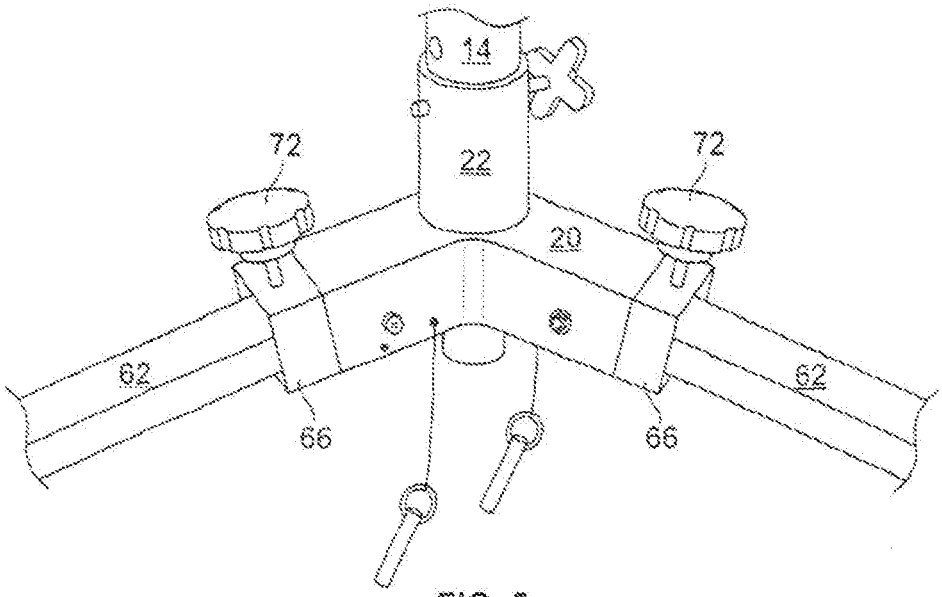
FIG. 5 is a close up perspective view of the base or hub portion of the seat and table stand assembly of FIG. 4, showing each leg adjustment mechanism at a predetermined distance from the pivotal axis of each leg connection to the base or hub portion.
Figure 6:
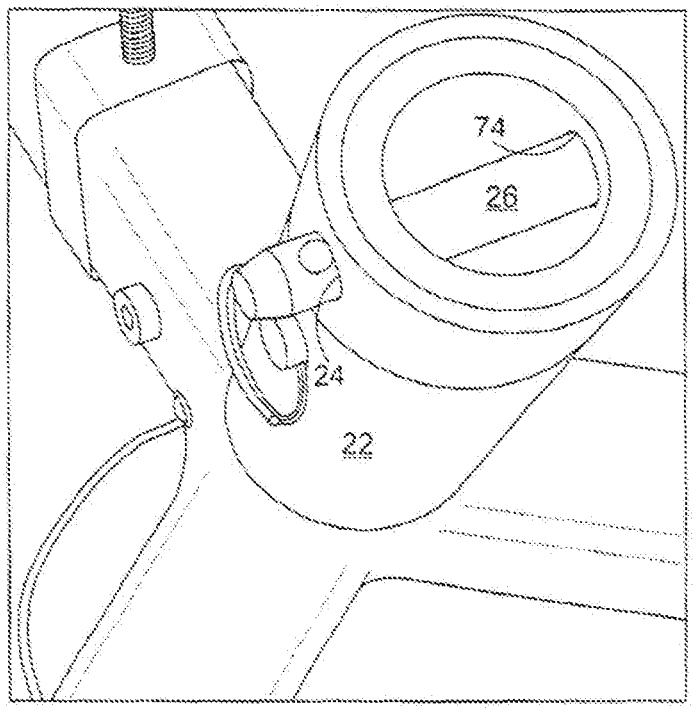
FIG. 6 is a detail perspective view of the base or hum portion of FIG. 5, showing the removable pin connection between the base and the supporting shaft when the supporting shaft is in the lowered or storage position.
Figure 7:
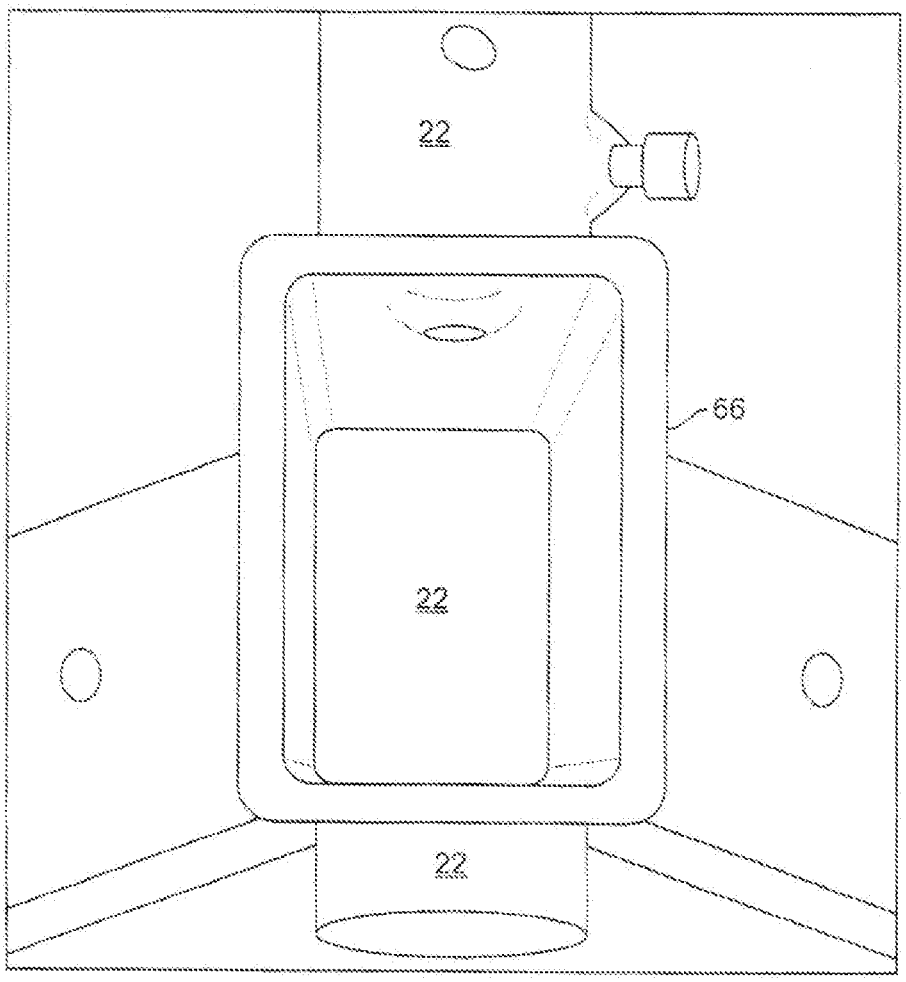
FIG. 7 is a detail side view of one of the inverted U-shaped mounting brackets for the leg adjustment mechanism, showing the reinforced threaded aperture that receives the threaded shaft of the leg adjustment mechanism.

As seen in FIG. 7, mounting bracket 22 of base assembly 20 is formed as a hollow tube, wherein inverted U-shaped brackets 66 are attached, such as by welding, to the outer surface of bracket 22. Shaft 14 is attached to bracket 22 by removable pin 26. After removing table 12 and seat 30 from shaft 14, and also removing collar 42 by lifting the collar to the top of shaft 14 if desired, by removing pin 26 shaft 14 slides through mounting bracket 22 until shaft 14 reaches the storage position shown in FIGS. 9 and 10. As seen in FIG. 10, pin 26 is reinserted through aperture 24 in bracket 22, and through an aligned aperture 74 adjacent the top of shaft 14 (FIGS. 4 and 6). In this manner, shaft 14 is connected to mounting bracket 22 as seen in FIG. 10.

Legs 62 are then each rotated around pins 64 until they reach the position shown in FIGS. 8-10, substantially parallel to shaft 14. In this position, pins 76, (FIGS. 4, 8, 9, 10) are inserted through apertures 78 in brackets 66. Pins 76 also extend through apertures (not shown) near the inner end of each leg. By thus inserting pins 76 through apertures 78 legs 62 are locked into the position shown in FIG. 9, and the folded legs 26 and shaft 14 can be manually transported, as shown in FIG. 10.

To prevent the loss or misplacement of pins 76, each pin 76 is attached to a bracket 66 by a small wire 80 that is attached to a pin 76 at one end and to bracket 66 at the other end.

The foregoing description of an illustrated embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A shooting seat and table stand assembly comprising:

a table having a base;

a shaft having a top end and a bottom end, the shaft removably mounted to a first cylindrical bracket, the first cylindrical bracket fixedly attached to the base, the shaft moveably mounted to extend through said first cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft; and a hollow second cylindrical bracket attached to the base assembly and vertically slideably mounted on the shaft, said hollow second cylindrical bracket adapted to receive the lower end of the shaft and said shaft adapted to extend through the base assembly such that the top end of the shaft engages the hollow second cylindrical bracket for storage.

2. The shooting seat and table stand assembly of claim 1, further comprising:

a pair of opposed first apertures disposed in said collar, said pair of opposed apertures adapted to be in alignment with one of a plurality of opposed second apertures in the shaft; and a removable pin adapted to extend through said first apertures and said second apertures to secure the collar in a fixed position relative to the shaft.

3. The shooting seat and table stand assembly of claim 1, wherein the table comprises a planar surface adapted to support a user's upper body and arms when aiming a firearm at a target.

4. The shooting seat and table stand assembly of claim 3, wherein the planar surface includes a cut out portion equally dimensioned on a first side and a second side, said cut out portion adapted to allow the table to be used by a right-handed user and a left-handed user.

5. The shooting seat and table stand assembly of claim 3, wherein the planar surface is substantially L-shaped.

6. The shooting seat and table stand assembly of claim 1, wherein the table is supported by a triangular-shaped support bracket rigidly attached at a first end to a hollow bracket collar that fits over the top end of the shaft, said hollow bracket collar and table adapted to rotate freely about the shaft.

7. A shooting seat and table stand assembly comprising:

a table having a base;

a shaft having a top end and a bottom end, the shaft removably mounted to a first cylindrical bracket, the first cylindrical bracket fixedly attached to the base, the shaft moveably mounted to extend through said first cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft;

a hollow second cylindrical bracket attached to the base assembly, said hollow second cylindrical bracket adapted to receive the lower end of the shaft and said shaft adapted to extend through the hollow second cylindrical bracket;

a plurality of laterally extending inverted U-shaped brackets forming part of said base assembly; and a plurality of laterally extending legs, each leg pivotally attached to one of said inverted U-shaped brackets, at least one of said legs being pivotally adjustable to maintain the shaft in a substantially vertical position when the legs of said shooting seat and table stand assembly are situated on uneven terrain, said legs rotatable about a pivot line extending horizontally through said inverted U-shaped bracket.

8. The shooting seat and table stand assembly of claim 7, further comprising:

a threaded leg adjustment shaft extending vertically through a threaded aperture in each inverted U-shaped bracket, said shaft having a manual adjustment knob at an upper end and allowing one end of each shaft to be in contact with a corresponding leg.

9. The shooting seat and table stand assembly of claim 8, further comprising:

each said threaded leg adjustment shaft having an axial centerline, said centerline located a predetermined lateral distance from said pivot line about which said legs rotate, said predetermined lateral distance providing a lever action when said threaded leg adjustment shaft is rotated downward and in contact with a corresponding leg.

10. The shooting seat and table stand assembly of claim 7, further comprising:

a knob having a vertically extending threaded shaft adapted to engage and extend through an aperture in said first cylindrical bracket, said knob and threaded shaft adapted to secure the table to the top end of the shaft.

11. The shooting seat and table stand assembly of claim 7, wherein the plurality of laterally extending legs are pivotally attached to the plurality of laterally extending inverted U-shaped brackets by a plurality of removable pins, said plurality of laterally extending legs adapted to be adjustable to multiple angles about said plurality of removable pins.

12. The shooting seat and table stand assembly of claim 7, wherein the plurality of laterally extending inverted U-shaped brackets are fixed to the hollow second cylindrical bracket.

13. A shooting seat and table stand assembly comprising:

a table having a base;

a shaft having a top end and a bottom end, the shaft removably mounted to a first cylindrical bracket, the first cylindrical bracket fixedly attached to the base, the shaft moveably mounted to extend through said first cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft; and a hollow second cylindrical bracket attached to the base assembly, the hollow second cylindrical bracket comprising opposed apertures adapted to receive a removable pin that extends through a pair of opposed lower apertures in the shaft, said pair of opposed lower apertures adjacent to the bottom end of the shaft and adapted to secure the shaft to the base assembly, and the hollow second cylindrical bracket adapted to receive the lower end of the shaft and said shaft adapted to extend through the base assembly.

14. The shooting seat and table stand assembly of claim 13, wherein the removable pin engages the opposed apertures in the hollow cylindrical bracket and the removable pin engages an aligned aperture adjacent the top end of the shaft when the shaft is in a storage position and connected to the hollow cylindrical bracket.

15. A shooting seat and table stand assembly comprising:

a table having a base;

a shaft having a top end and a bottom end, the shaft removably mounted to a first cylindrical bracket, the first cylindrical bracket fixedly attached to the base, the shaft moveably mounted to extend through said first cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft;

a hollow second cylindrical bracket attached to the base assembly, said hollow second cylindrical bracket adapted to receive the lower end of the shaft and said shaft adapted to extend through the hollow second cylindrical bracket;

a seat in communication with the seat assembly;

a cantilever arm rigidly supported on a hollow third cylindrical bracket that is vertically adjustable relative to the shaft, said cantilever arm adapted to support said seat;

a support plate rigidly attached to said hollow third cylindrical bracket, said support plate extending beneath and attached to an under-surface of said cantilever arm; and said hollow third cylindrical bracket rotatable about the shaft and rotatable on the upper surface of the collar.

16. A shooting seat and table stand assembly comprising:

a table having a base;

a shaft having a top end and a bottom end, the shaft removably mounted to a first cylindrical bracket, the first cylindrical bracket fixedly attached to the base, the shaft moveably mounted to extend through said first cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft;

a seat in communication with the seat assembly;

a cantilever arm rigidly supported on a hollow second cylindrical bracket that is vertically adjustable relative to the shaft, said cantilever arm adapted to support said seat;

a support plate rigidly attached to said hollow second cylindrical bracket, said support plate extending beneath and attached to an under-surface of said cantilever arm;

said hollow second cylindrical bracket rotatable about the shaft and rotatable on the upper surface of the collar;

a seat shaft attached to the bottom of said seat;

a plurality of linearly arrayed and opposed apertures extending through said cantilever arm, said apertures adapted to removably receive the seat shaft; and said seat laterally adjustable relative to the table.

17. A shooting seat and table stand assembly comprising:

a table having a base;

a shaft having a top end and a bottom end, the shaft removably mounted to a first cylindrical bracket, the first cylindrical bracket fixedly attached to the base, the shaft moveably mounted to extend through said first cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft;

a seat in communication with the seat assembly;

a cantilever arm rigidly supported on a hollow second cylindrical bracket that is vertically adjustable relative to the shaft, said cantilever arm adapted to support said seat;

a support plate rigidly attached to said hollow second cylindrical bracket, said support plate extending beneath and attached to an under-surface of said cantilever arm;

said second hollow cylindrical bracket rotatable about the shaft and rotatable on the upper surface of the collar; and a threaded knob having a threaded knob shaft adapted to frictionally engage the shaft to prevent rotation of the cantilever arm and the seat once the seat has been placed in a desired rotative position and the threaded knob has been placed in a locked position.

18. A shooting seat and table stand assembly comprising:

a table having a base;

a shaft having a top end and a bottom end, the shaft removably mounted to a cylindrical bracket, the cylindrical bracket fixedly attached to the base, the shaft moveably mounted to extend through said cylindrical bracket;

the shaft removably mounted to a base assembly adjacent the bottom end of the shaft, the shaft removably mounted to the base adjacent the top end of the shaft;

a seat assembly mounted on said shaft for vertical and rotational movement relative to said shaft;

a collar vertically slideably mounted on said shaft, said collar supporting said seat assembly in a variable fixed vertical position when said collar is fixed to the shaft;

a plurality of laterally extending inverted U-shaped brackets forming part of said base assembly;

a plurality of laterally extending legs, each leg pivotally attached to one of said inverted U-shaped brackets, at least one of said legs being pivotally adjustable to maintain the shaft in a substantially vertical position when the legs of said shooting seat and table stand assembly are situated on uneven terrain, said legs rotatable about a pivot line extending horizontally through said inverted U-shaped bracket; and a removable pin adapted to removably engage a first aperture in each inverted U-shaped bracket and a second aperture near the inner end of each corresponding leg, said removable pin adapted to lock the corresponding leg in a folded position.

19. The shooting seat and table stand assembly of claim 18, further comprising:

a small wire attached to the removable pin at a first end and attached to each inverted U-shaped bracket at a second end, said small wire adapted to prevent the loss of the removable pin.

* * * * *